US005562274A

United States Patent [19]

Kitchen et al.

[11] Patent Number: 5,562,274

[45] Date of Patent: Oct. 8, 1996

[54] FORMED WIRE MATTRESS ASSEMBLY

[75] Inventors: John P. Kitchen, Georgetown; William C. Rodgers, Lexington, both of Ky.

[73] Assignee: Hoover Wire Products, Inc., Georgetown, Ky.

[21] Appl. No.: 255,372

[22] Filed: Jun. 8, 1994

[51] Int. Cl.[6] ..... F16F 3/00

[52] U.S. Cl. ..... 267/103; 267/106; 267/110; 5/255; 5/719

[58] Field of Search ..... 267/91, 92, 97, 267/99, 103, 106, 110, 131, 143, 144; 5/247, 255, 476

[56] References Cited

U.S. PATENT DOCUMENTS 3,161,408 12/1964 Molt ..... 267/91 X
4,475,724 10/1984 Hancock ..... 267/103
5,246,210 9/1993 Dabney et al. ..... 5/247 X
5,401,007 3/1995 Dabney et al. ..... 267/103
5,418,989 5/1995 Roe ..... 5/255 X

*Primary Examiner*—Josie Ballato
*Attorney, Agent, or Firm*—Harness, Dickey & Pierce, P.L.C.

[57] ABSTRACT

A formed wire spring assembly having upper and lower spaced decks including a border wire and a plurality of deck wires arranged in a criss-cross fashion. The deck wires of the upper deck and lower decks are paired with one another and are connected by springs disposed between the two decks to support the decks in spaced relationship and yieldable fashion relative to one another.

20 Claims, 8 Drawing Sheets

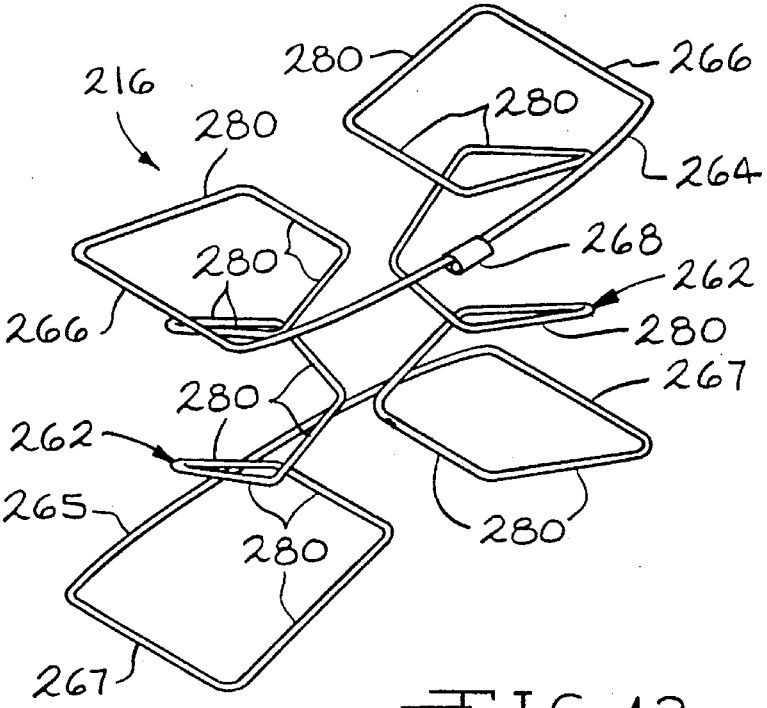
FIG. 12
FIG. 13
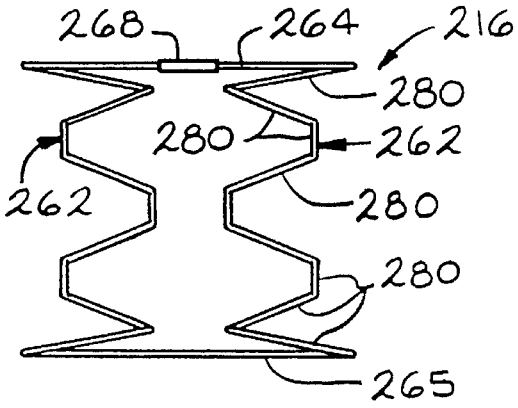
FIG. 14
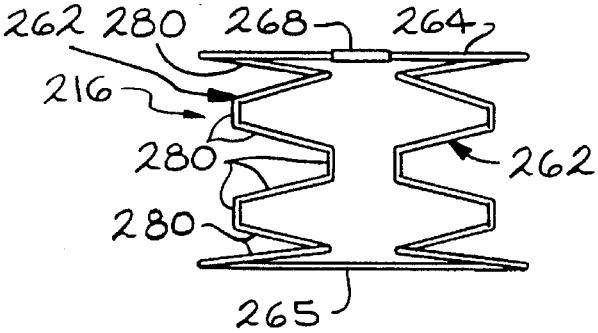
FIG. 15
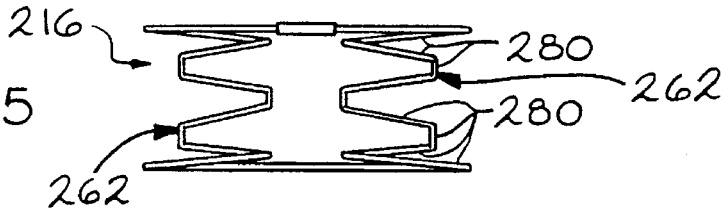

FORMED WIRE MATTRESS ASSEMBLY

BACKGROUND OF THE INVENTION

The present invention generally relates to spring wire cores for use in seat cushions, mattresses and the like. More particularly, the invention relates to a formed wire mattress assembly intended for use as a primary bedding mattress having the advantages of component assembly at the upholstery facility.

While primary bedding mattresses are known to exist in a variety of styles, the most common forms are comprised of coil springs, continuous or individual, aligned in rows that form a generally rectangular shape. Lacing wires on the top and bottom surfaces of the coil springs hold the coil springs in place and provide for a yieldable core. A border wire, that conforms to the rectangular shape of the entire coil assembly, is then affixed to each of the top and bottom surfaces to define the perimeter of the coil mattress core.

When shipping the assembled cores to the upholstery manufacturer, packaging requires the full compression of fourteen to twenty cores and the use of crating material and baling wire ties to prevent decompression. Heavy unbaling equipment is required at the upholstery facility to reverse the packaging process and control the dangerously high loads involved. The storage space required to house the fully expanded and unused portions of the unbaled cores can be a significant problem.

Another variety of mattress assembly, herein referred to as a secondary bedding mattress, is illustrated in U.S. Pat. No. 4,475,724 which is commonly assigned to the assignee of the present application. The mattress assembly of the '724 patent is a wire spring assembly for a sleeper sofa. The assembly consists of a number of resilient wire spring units which are secured to one another and arranged in rows so that the entire assembly is allowed to flex as it is folded into or out of the sleeper sofa. This type of wire formed mattress assembly, has distinct advantages over a coil assembly. Because the lacing wire method of attaching the coils is omitted, the noise created by the lacing wires is eliminated and a more economical use of wire is achieved. However, this assembly is not suitable as a primary bedding mattress from the standpoint of user comfort. One problem is the low height required for sofa/sleeper mattresses cannot provide the proper contour loading necessary for long term usage.

It is therefore an object of the present invention to provide for the production of a formed wire mattress assembly specifically intended for use as a primary bedding mattress.

Another object of the present invention is to decease the number of components required in the formed wire mattress assembly to allow for knock down shipment of parts and assembly of the core at the upholstery facility.

It is a further object of this invention to enable style and firmness changes in the mattress through individual component substitution rather than full assembly substitution.

Yet another object of this invention is to provide a mattress assembly which offers a substantial amount of support along the edge or perimeter areas of the assembly.

The present invention also has as an object eliminating the use of coil springs in a mattress assembly.

Another object of this invention is to provide a mattress assembly which offers the same support characteristics on both its top and bottom surfaces.

And still another object of this invention is to provide a mattress assembly which incorporates spring units that may vary in gage, style and function to control the behavior characteristics of the mattress assembly.

SUMMARY OF THE INVENTION

The formed wire mattress assembly of the present invention provides a mattress which uses a pair of support decks or platforms that are formed as grid networks of deck wires that provide improved support. This is achieved by constructing the mattress assembly so that the support decks are formed entirely of high carbon spring wire instead of low carbon basic wire which is not nearly as strong or durable as the high carbon spring wire.

Spring modules of formed wire are attached to the support decks to space apart and yieldably support the decks relative to one another. The spring modules themselves include portions which also help define the surface of the support decks and which provide the opposing surfaces of the assembly with the same performance and support. This allows the mattress assembly to be used with either support deck located in the up or top position and functioning as the sleep surface.

The mattress assembly of this invention also incorporates features which help to prevent side-to-side or relative part movement. The assembly therefore has the advantage of stability. One way this is achieved is by notching and clipping the deck wires to each other and to the spring modules. Additionally, other components of the assembly interact with one another to limit further side sway of the assembled mattress.

One element which helps to limit sway and which helps to secure the assembly together are the lever arms detailed by the invention. The lever arms extend interiorly from the edge springs and are coupled to the deck wires of the support decks. The lever arms are unitarily formed with either the deck wires or with the edge springs.

More specifically, the present formed wire mattress assembly includes a pair of vertically spaced decks or platforms which form the two major support surfaces of the finished mattress. Each deck includes a rectangular border wire and a series of deck wires arranged in a grid network where some of the deck wires extend lengthwise of the assembly and others extend crosswise of the assembly. Each deck wire of the upper support deck is generally vertically aligned above a deck wire in the lower support deck. The assembly is therefore provided with aligned or opposed pairs of deck wires. At the ends and sides of the upper and lower support decks, an edge spring vertically extends between the opposing border wires.

In one embodiment of the invention, each deck wire is unitarily formed so as to incorporate one end spring while its opposing end terminates at the border wire adjacent the edge spring of the opposing deck wire. In another embodiment, some of the deck wires incorporate an end spring at each end while the opposing deck wire terminates at each end adjacent to the border wire defining the perimeter of that particular support deck.

Spring modules are secured and attached between the support decks to vertically space apart and yieldable support the decks relative to one another. Each spring has a pair of upstanding yieldable portions, extending between the decks. The yieldable portions terminate in upper ends attached to the upper support deck and lower ends attached to the lower support deck. These upper and lower ends are part of mounting portions that coact with the deck wires and connect the yieldable portions to one another. In one embodiment, the yieldable portions of each spring are connected together by the mounting portions at both the upper and lower ends so that the formed wire spring is a continuous loop. In this manner, the mounting portions cooperate with the deck wires and form part of the support surface defined by the support decks. Since both the upper and lower ends of the yieldable portions are interconnected, the mattress assembly exhibits the same feel and performance characteristics regardless of which support deck is located in the upper position for use as the sleep surface. Also, the continuous loop design contributes to the anti-sway resistance of the assembly.

Another feature of the present invention is a formed deck wire. The formed deck wire includes a series of formed portions which coincide with the location of the springs and the intersections with other deck wires. The formed portions operate as a surface spring system which relieves the bridging stresses at the intersection points and provides for contouring enhancement of surface loads.

Further objects, features and advantages of the present invention will become apparent from a consideration of the following description and the appended claims when considered in connection with the accompanying drawings.

BRIEF DESCRIPTION OF THE DRAWINGS

FIG. 12 is a perspective view of the variable rate spring used in the mattress assembly shown in FIG. 11;

FIG. 13 is a side elevational view of the variable rate spring shown in FIG. 12;

FIG. 14 is a side elevational view of the variable rate spring illustrated in FIG. 13 in a partially compressed condition;

FIG. 15 is a side elevational view of the variable rate spring seen in FIGS. 13 and 14 in a fully compressed condition;

DETAILED DESCRIPTION Of THE PREFERRED EMBODIMENTS

Figure 1:
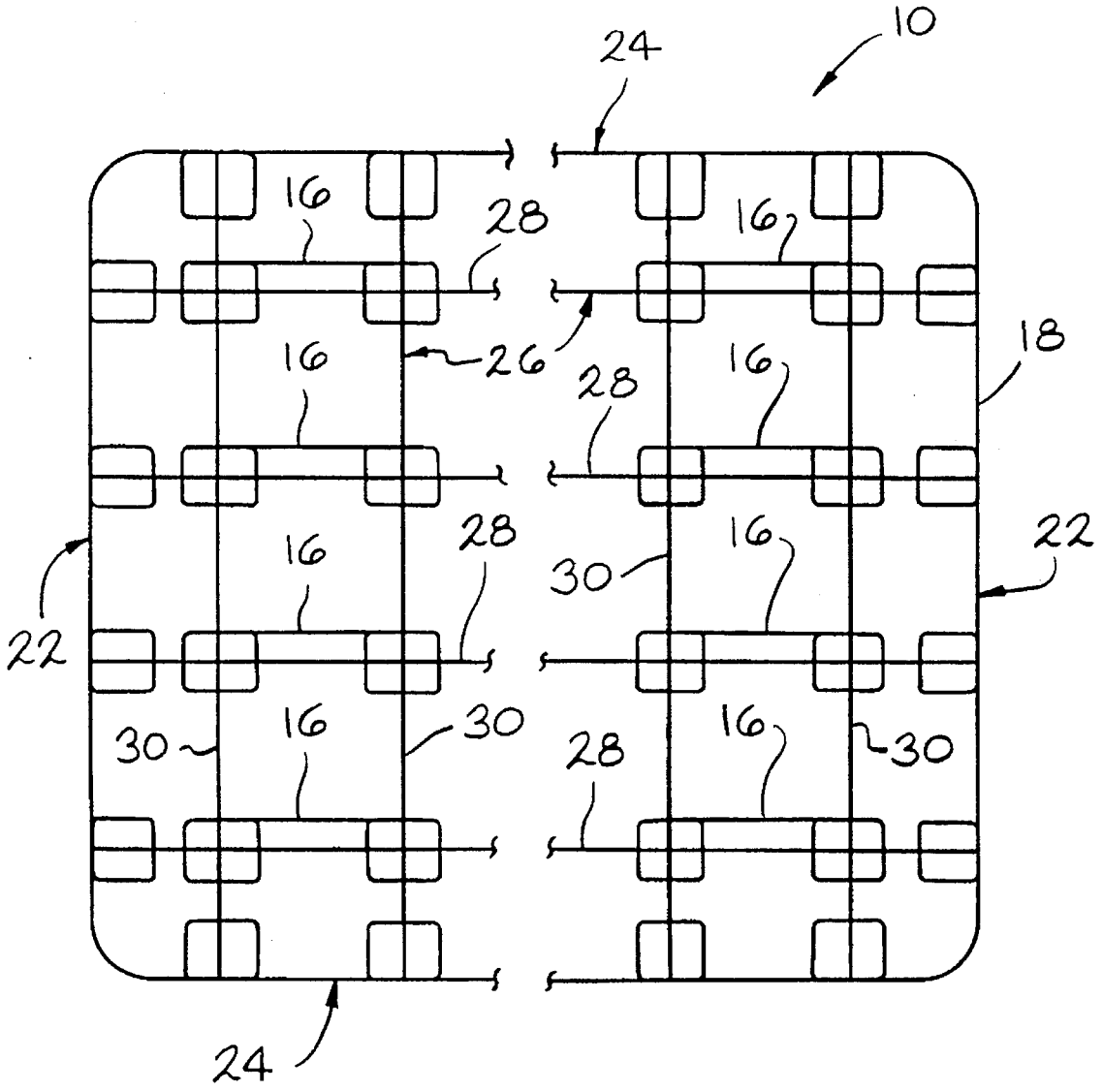
FIG. 1 is a schematic, top plan view of the formed wire mattress assembly of the present invention.
Figure 2:
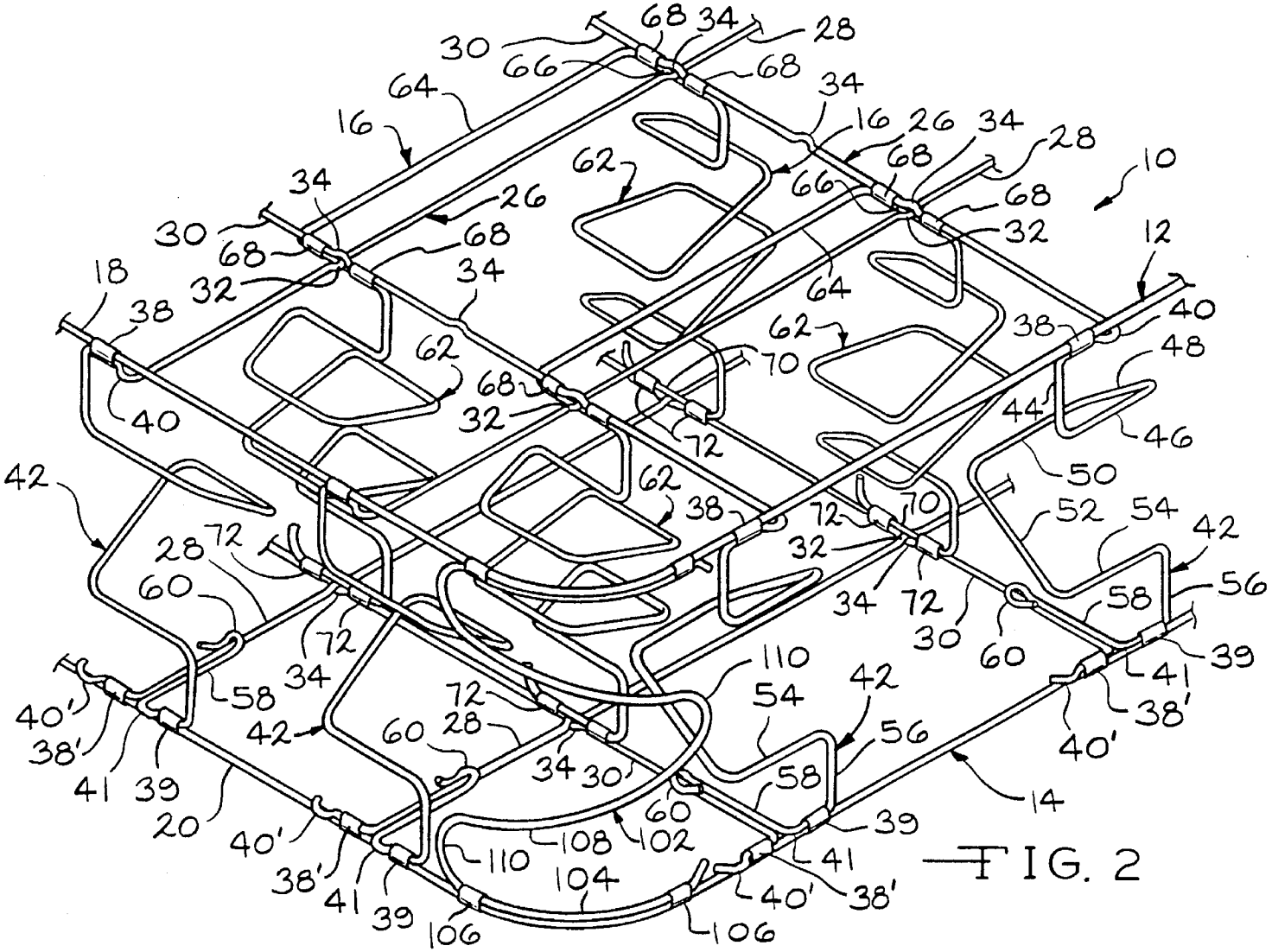
FIG. 2 is a partial perspective view of one embodiment of a formed wire mattress assembly incorporating the principles of the present invention.

A formed wire mattress assembly incorporating the principles of the present invention is illustrated in FIG. 1 and generally designated at 10. As seen in FIG. 2, the spring assembly 10 has as its primary elements an upper support deck 12, a lower support deck 14, and a plurality of spring modules 16.

Both the upper and lower support decks 12 and 14 are generally rectangular in shape and defined about their perimeters by upper and lower border wires 18 and 20, respectively, which further define the longitudinal ends 22 and lateral sides 24 of the support decks 12 and 14 as well as the assembly 10. The upper and lower support decks 12 and 14 include deck wires, generally designated at 26, which cooperate with one another to form a grid-like network within the perimeter defined by the border wires 18 and 20. The deck wires 26 are generally of two kinds, long wires 28 and cross wires 30. The long wires 28 extend lengthwise of the assembly 12 from one opposing end 22 to the other. Likewise, the cross wires 30 extend crosswise of the assembly 12 from one side 24 of the support deck to the opposing side 24. The long wires 28 include downwardly oriented notches 32 at predetermined locations along their lengths. Similarly, the cross wires 30 are formed with upwardly oriented notches 34 that coincide with the notches 32 at the intersections with the long wires 28.

Referring now to FIG. 2, the specific structures of the mattress assembly 10 can be seen in greater detail therein. As mentioned above, the long wires 28 and the cross wires 30 respectively extend from end-to-end and side-to-side of the upper and lower support decks 12 and 14. At the respective ends and sides of the support decks 12 and 14, the long wires 28 and cross wires 30 are attached to the border wires 18 and 20. To permit securement to the border wires 18 and 20, the long wires and cross wires terminate in attachment bars 36 which are oriented generally perpendicular to the long wires 28 and cross wires 30 and parallel to the border wires 18 or 20. While the attachment bars 36 can be secured to the border wires 18 and 20 through a variety of methods known in the industry, attachment is preferably accomplished through the use of clips or sleeve ferrules 38.

Where the long wires 28 and cross wires 30 transition into the attachment bars 36, or alternatively after transitioning into the attachment bars 36, a return bent extension or ledge 40 is provided. As seen in FIG. 2, the ledge 40 is configured to extend beyond the perimeter of the upper and lower decks 12 and 14 as defined by the border wires 18 and 20. By extending beyond the border wires 18 and 20, the ledges 40 prevent the perimeter defined by border wires 18 and 20 from "rolling" around the attachment bars 36. This stabilizes the border wires 18 and 20 relative to the attachment bars 36 and prevents the perimeter of the assembly 10 from breaking down both in terms of form and support.

Figure 3:
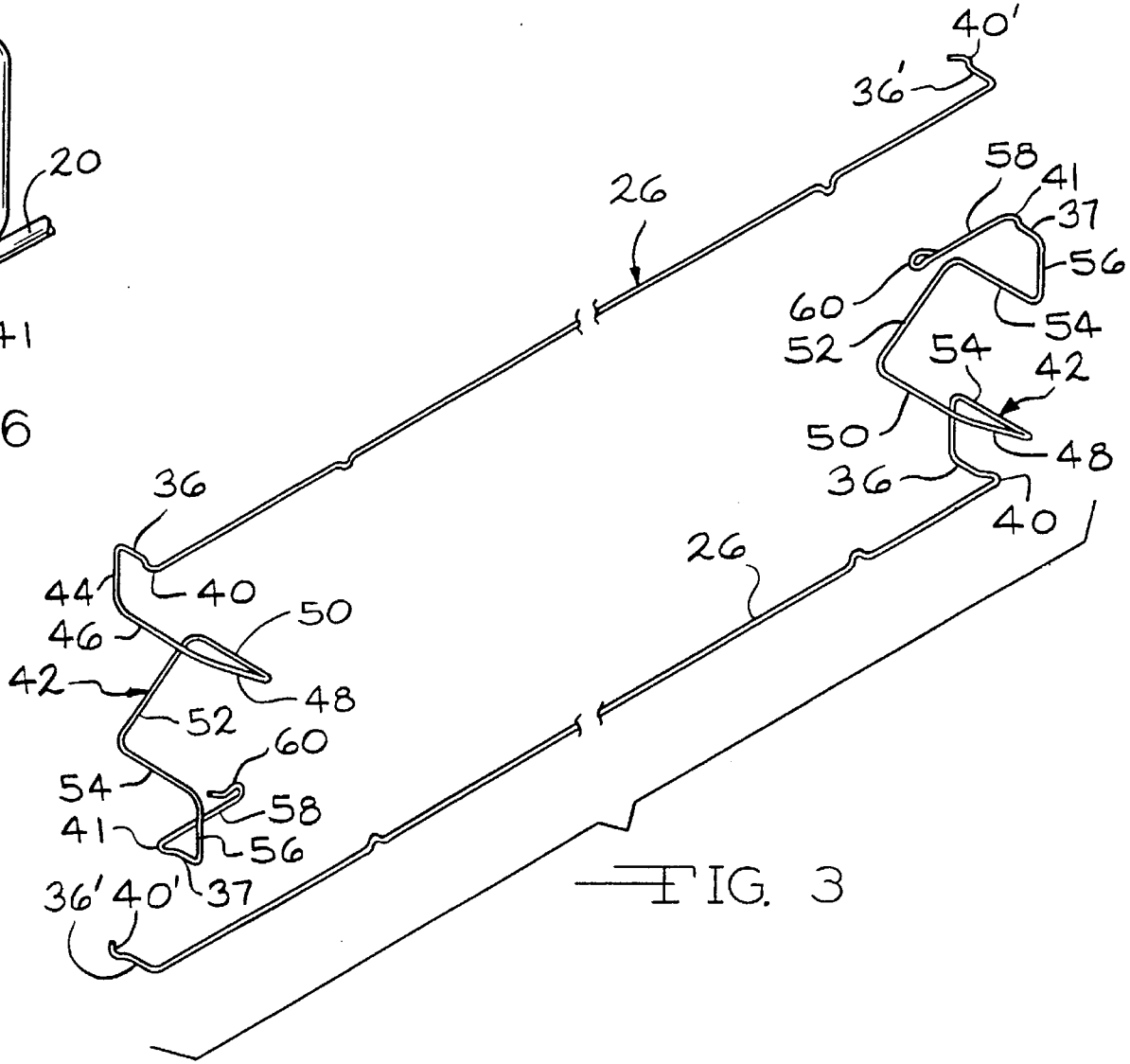
FIG. 3 is a perspective view of one embodiment of the deck wires used in the formed wire mattress assembly of the present invention.

Extending between the support decks 12 and 14, and more specifically between the upper border wire 18 and the lower border wire 20, are spring segments or edge springs 42. The edge springs 42 yieldably support the edge of the upper deck 12 relative to the edge of the lower deck 14 and are located at spaced intervals around the perimeter of the entire assembly 10. While basically the same in form and function, the edge springs 42 are illustrated as being provided in three different embodiments. In the first of these embodiments, as seen in FIGS. 2 and 3, each long wire 28 and cross wire 30 of the upper and lower decks 12 and 14 has one edge spring 42 unitarily formed with it. In a second embodiment, shown in FIG. 4, the edge spring 42" is independently formed from the long and cross wires 28 and 30 of the upper and lower decks 12 and 14. In the final embodiment, seen in FIG. 5, one long or cross wire 28 or 30 is unitarily formed with edge springs 42" at both of its ends. The opposing or corresponding long or cross wire 28 or 30 conversely lacks any edge springs.

While the present invention is being described as having long and cross wires, the terms "long" and "cross" are being used to designate the direction in which the particular deck wire 26 is extending relative to the assembly 10. The terms are therefore not ones of limitation since by varying their lengths, the cross wires could be substituted for the long wires and vice versa.

Referring now to that embodiment of the long and cross wires best illustrated in FIGS. 2 and 3, it can be seen that the edge springs 42 integrally extend from the attachment bars 36 in an upright and generally vertical segment 44. The vertical segment 44 is then bent approximately 90° to extend generally parallel to the border wires 18 and 20 and form a torsion bar segment 46. The opposing end of the torsion bar segment 46 is bent 90° relative thereto and extends as segment 48. Segment 48, as seen in FIG. 3, diverges out of the vertical plane defined by the attachment bar 36, vertical segment 44 and torsion bar segment 46 and is angled relative to the plane or surface being defined by the upper support deck 12. For this reason, segment 48 is herein referred to as inclined segment 48. Approximately half way between the upper and lower support decks 12 and 14, the inclined segment 48 terminates in a second torsion bar segment 50 which is substantially parallel to the first torsion bar segment 46 and located interiorly of the assembly's perimeter. The second torsion bar segment 50 is again bent approximately 90° and angled to extend as a second inclined segment 52. This second inclined segment 52 is then bent 90° to form a third torsion bar segment 54. The third torsion bar segment 54 is generally parallel to and substantially vertically aligned with the first torsion bar segment 46. At the lower end of the edge spring 42, the third torsion bar segment 54 is bent approximately 90° to form a second vertical segment 56 further bent to form a lower attachment bar 37 which is parallel with the border wire 20 and connected thereto by a clip 39. Similar to the deck wires 26, the lower attachment bar 37 may be provided with a return bent extension or ledge 41 to prevent rolling of the border wire 20 therearound.

Figure 6:
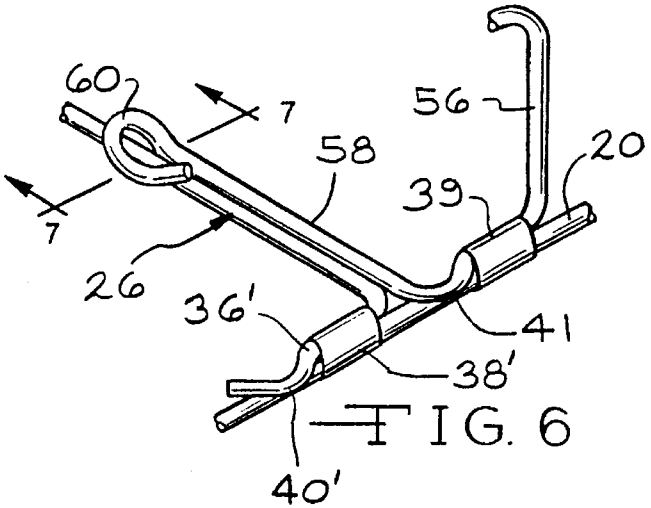
FIG. 6 is an enlarged perspective view of a portion of the formed wire mattress assembly of the present invention.
Figure 7:
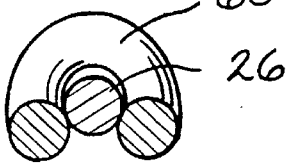
FIG. 7 is a sectional view taken substantially along the line 7—7 in FIG. 6.

The edge spring 42 terminates in lever arms 58 which extends inward from the lower attachment bar 37. The lever arm 58 is generally parallel to the paired lower deck wire 26 and cooperates to prevent rotation of the attachment bars 37 about the border wires 18 and 20 when the assembly 10 is loaded. This further improves the side-to-side stability of the mattress assembly 10. The terminal ends of the lever arm 58 includes a return bend or hook 60 which is looped over the adjacent lower deck wire 26 to lock the edge spring 42 in its use position. This is the best seen in FIGS. 6 and 7.

While set out in some detail, the specific structure of the edge spring is only intended to illustrate one example of the many spring configurations which could be utilized with the present invention. The invention is therefore not solely limited to the edge spring 42 configuration as shown.

Opposite the edge springs 42, the deck wire 26 terminates in an attachment bar 36' which is bent approximately 90° from the deck wire 26 and which is generally parallel to the border wire 18. The attachment bar 36' similarly terminates in a return bent extension or ledge 40'. Like the opposing end of the deck wire 26, the attachment bar 36' is secured to the border wire 18 by a clip 38' and the ledge 40' prevents rolling of the border wire 18 about the attachment bar 36'. Similar to that described above, the edge spring 42 of the corresponding lower deck wire 26 extends up from the lower border wire 20 to the upper border wire 18 where its lever arm 58 and hook 60 secure it to the upper deck wire 26.

The second and third embodiments of the deck wires 26 and the edge springs 42 are similar in configuration to that described in connection with the embodiment shown in FIG. 3. For this reason, corresponding elements have been designated with the corresponding item numbers and will not be described in significant detail.

Figure 4:
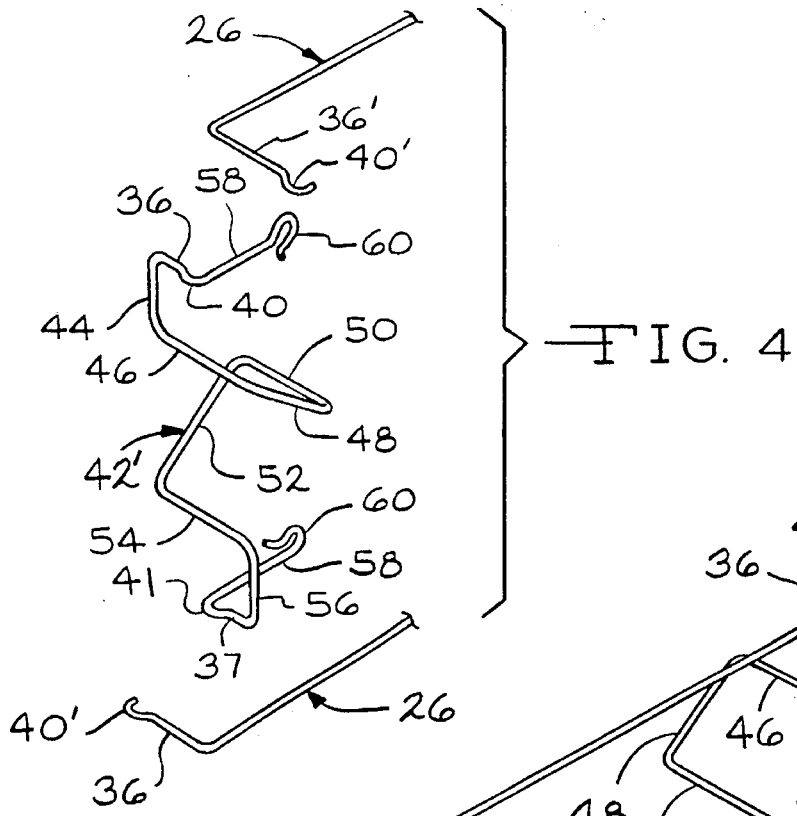
FIG. 4 is a partial perspective view of another embodiment of the deck wires used in the formed wire mattress assembly of the present invention.

The second embodiment, seen in FIG. 4, differs from the first embodiment in that the edge spring 42' is independently formed from the deck wire 26. Accordingly, the edge spring 42' includes lever arms 58 and hooks 60 at its upper and lower ends and the deck wires 26 are formed with attachment bars 36' and ledges 40' at both of their ends.

Figure 5:
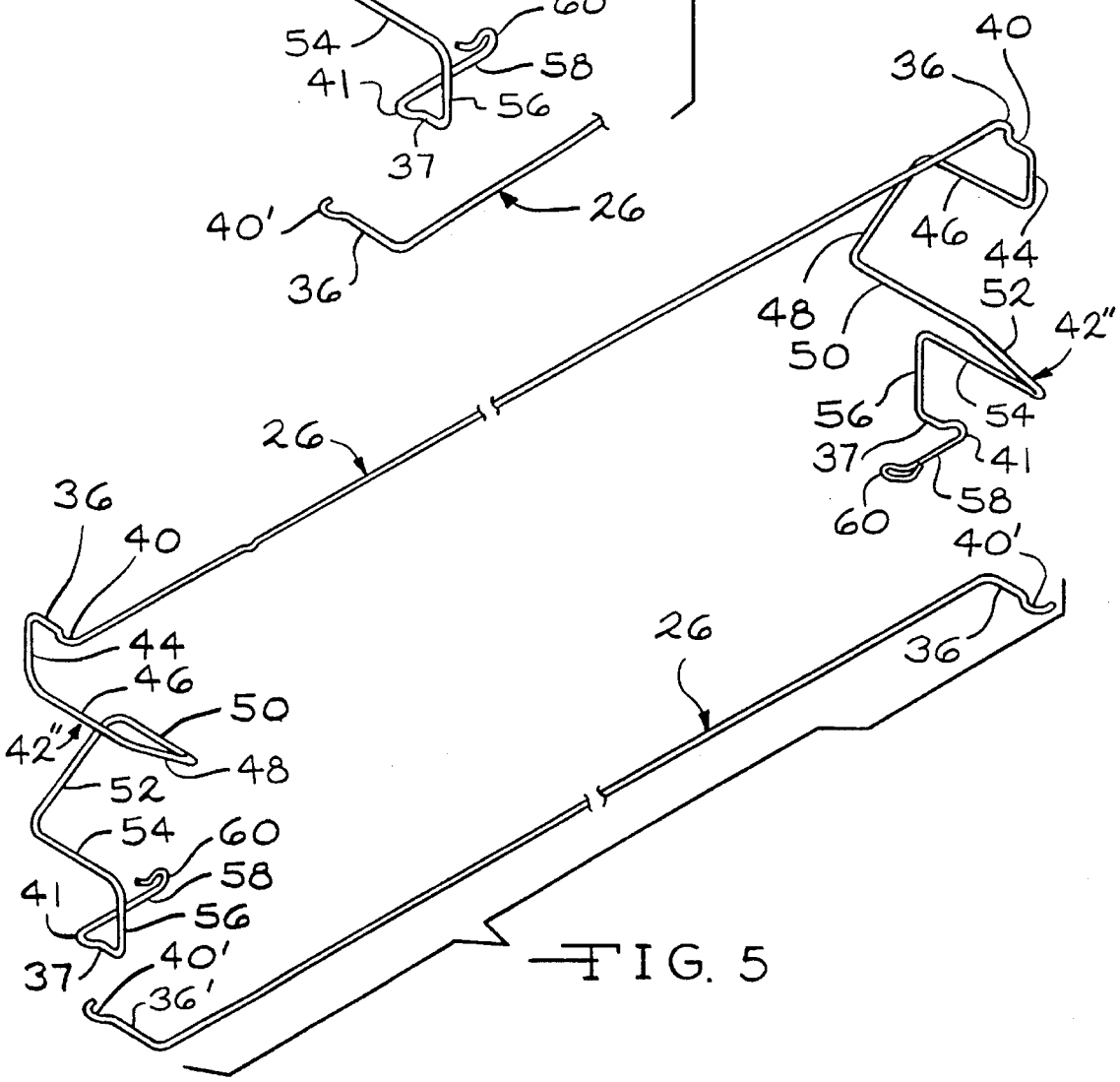
FIG. 5 is a perspective view of a third embodiment of the deck wires used in the formed wire mattress assembly of the present invention.
Figure 8:
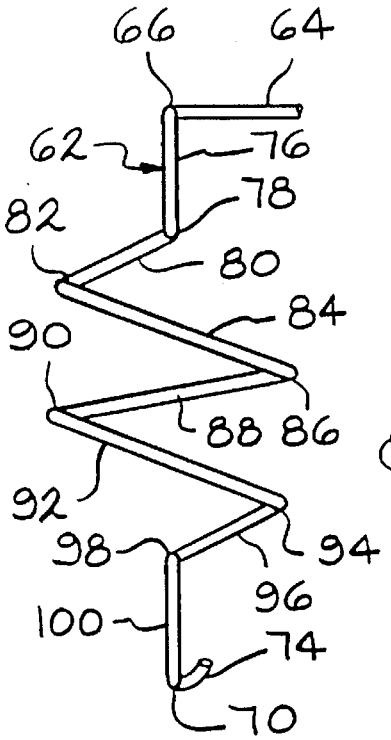
FIG. 8 is a partial side elevational view of a variable rate spring used in the formed wire mattress assembly of the present invention.

The third embodiment of FIG. 5 differs from the first embodiment in that one of the deck wires 26 is unitarily formed so as to have edge springs 42' formed at both of its ends. The opposing deck wire 26 is correspondingly formed so that both of its ends include the attachment bars 36' and the ledges 40'.

As previously mentioned, spring modules 16 are provided between and attached to the upper and lower support decks 12 and 14 to vertically space apart and yieldably support the upper and lower decks 12 and 14 relative to one another. Each spring module 16 is made from a single piece of spring wire which has been formed or bent to form a pair of vertically yieldable spring portions 62. The yieldable portions 62 are coupled to one another at their upper ends by a connecting bar 64 that is unitary with the yieldable portions 62. Also at their upper ends, the yieldable portions 62 are formed so that they incorporate attaching bars 66 oriented approximately 90° from the connecting bars 64 and therefore parallel with the one set of deck wires 26 and transverse to another set of deck wires 26. As seen in the illustrated embodiment of FIG. 2, the attaching bars 66 are parallel with and connected to the cross wires 30. As a matter of design choice, the spring modules 16 could alternatively be incorporated into the assembly 10 such that the attaching bars 66 are parallel with and connected to the long wires 28.

The spring modules 16 are mounted to the upper and lower decks 12 and 14 so that the attaching bar 66 are positioned at the intersection of the long and cross wires 28 and 30 enabling the attaching bar 66 to be secured by clips 68 on opposite sides of the long wire 28. By attaching the attaching bar 66 to the cross wires 30, the long wires 28 become sandwiched between the attaching bar 66 and the cross wires 30 securing the long wires 28 and cross wires 28 and 30 together. Because of their respective notches 32 and 34, the wires 28 and 30 are further secured by the clips 68 and attaching bars 66.

The lower ends of the yieldable portions 62 terminate in lower attaching bars 70 which are similarly clipped by clips 72 to the generally parallel cross wire 30 of the opposing deck 12 or 14. Attaching bars 70 terminate in curved feet 74 to limit the potential of the spring module 16 to separate from between the decks 12 and 14.

Between the attaching bars 66 and 70, the yieldable portions 62 are formed with a series of interconnected torsion bar segments and inclined or lever segments. Progressing from the upper attaching bar 66 toward the lower attaching bar 70, each yieldable portion 62 includes a generally vertical segment 76 which is then bent 90° to form a torsion bar 78. The torsion bar is generally parallel with the attaching bar 66 and located substantially vertically below it. The opposing end of the torsion bar 78 extends downwardly in a lever segment 80 which terminates in a second torsion bar 82. The lever segment diverges out of the plane defined by the attaching bar 66 and the torsion bar 78, While the second torsion bar 82 is generally parallel with the first torsion bar 78, it is vertically and horizontally offset from the first torsion bar 78 and the attaching bar 66. A second lever segment 84 extends from the opposite end of the second torsion bar 82 and similarly terminates in a third torsion bar 86 which is parallel to the second torsion bar 82 but vertically and horizontally offset therefrom. The third torsion bar 86 extends in another lever segment 88 before terminating in a fourth torsion bar segment 90 which is parallel to but vertically and horizontally offset from the third torsion bar 86. The fourth torsion bar segment 90 is, however, generally vertically aligned with the second torsion bar segment 82. A fourth lever segment 92 extends from the fourth torsion bar segment 90 to a fifth torsion bar segment 94. Again, the torsion bar segment 94 is parallel to but vertically and horizontally offset from the fourth torsion bar segment 90 but is generally vertically aligned with the third torsion bar segment 86. A fifth lever segment 96 extends from the fifth torsion bar segment 94 before terminating in a sixth torsion bar segment 98 which is generally vertically aligned with the first torsion bar segment 78 and parallel thereto. Finishing the construction of the yieldable portion 62, a second vertical segment 100 extends from the sixth torsion bar segment 98 to the lower attaching bar 70.

Since the lever segments are of varying lengths and angularly oriented with respect to the vertical segments 76 and 100 and to one another, the yieldable portions 62 of the spring module 16 are provided with a variable spring rate that is more easily compressed at first and which becomes more difficult to compress or firmer as the load on the assembly 10 increases.

Figure 9:
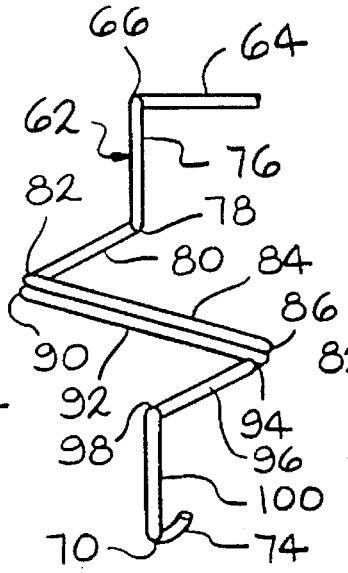
FIG. 9 is a side elevational view of the variable rate spring illustrated in FIG. 8 being partially compressed.
Figure 10:
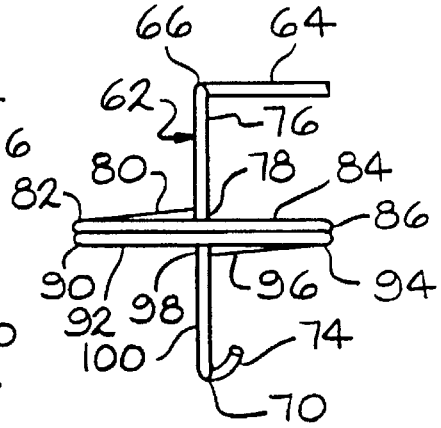
FIG. 10 is a side elevational view of the spring seen in FIGS. 8 and 9 further illustrating the condition of the spring when fully compressed.

As seen in FIGS. 9 and 10, as the yieldable portions 62 are loaded, the spring module 16 principally deflects about the third and fourth torsion bar segments 86 and 90 until the second, third and fourth lever segments 84, 88 and 92 are generally immediately adjacent to one another. If the spring module 16 is further loaded, deflection occurs about the first, second, fifth and sixth torsion bar segments 78, 82, 94 and 98. Deflection can continue until the spring module 16 is fully compressed as seen in FIG. 10.

As with the edge springs 42, the specific construction of the spring module 16 is not intended to strictly limit the present invention. The illustrated structure of the spring module 16 is only one example of the many spring configurations which can be utilized in the present invention.

At the corner of the assembly 10, the upper and lower border wires 18 and 20 are interconnected by corner spring 102. The corner spring is curved and corresponds with the shape of the assembly 10 at the corner. These springs 102 include mounting bars 104 at their upper and lower ends which are attached to the border wires 18 and 20 by clips 106. Between the mounting bars 104, the corner springs 102 can have any one of numerous yieldable configurations. In the illustrated embodiment of FIG. 2, the corner spring 102 is provided with a pair of inclined segments 108 interconnected to each other and the mounting bars 104 by return bent portions 110. As with the end springs 42 and spring module 16 discussed above, the corner springs 102 can be provided in numerous alternate configurations without compromising the performance of the assembly 10. Therefore, the present invention should not be interpreted as being limited to the specifically illustrated embodiment contained herein.

A further embodiment of the present invention is generally illustrated in FIGS. 11–15. The formed wire mattress assembly of this embodiment is generally designated at 210. For the sake of clarity, the elements of the assembly 210 are illustrated in line form and some of the clips for attaching the elements together are omitted.

The assembly 210 includes an upper support deck 212 and a lower support deck 214 which are yieldably supported and spaced apart by spring modules 216. The support decks 212 and 214 are respectively defined by a border wire 218 and 220 along their perimeters and include deck wires 226. The deck wires include long wires 228 extending lengthwise and cross wires 230 extending crosswise thereby forming a grid network of criss-crossed deck wires 226. The border wires 218 and 220, long wires 228 and cross wires 230 of the upper and lower decks 212 and 214 are vertically aligned with one another so that each of these elements has a corresponding element located in the opposing support deck.

In addition to the spring modules 216, the upper and lower support decks 212 and 214 are yieldably spaced apart by edge springs 242 located about the perimeter of the assembly 210. The edge springs, secured between the upper and lower border wires 218 and 220, like the previous embodiments, can have numerous different configurations to provide the desired amount of stiffness to the perimeter of the assembly 210. As with the previous embodiments, the edge springs 242 may be unitarily formed on one end of each corresponding deck wire 226, be unitarily formed on both ends of only one corresponding deck wire 226, or be independently formed from both corresponding deck wires 226. In the illustrated embodiment of FIG. 11, the edge springs 242 are independently formed from the deck wires 226 somewhat similar to the embodiment seen in FIG. 4. The edge springs 242 incorporate a series of torsion bar segments and inclined segments 248 which provide the desired stiffness to the edge of the assembly 210. The actual configuration of the edge springs 242, while being similar to that of FIG. 2, differs in that the middle or second torsion bar 250 is vertically aligned between the upper and lower border wires 218 and 220 while the remaining torsion bars 246 are offset toward the interior of the assembly 210. Also like the prior embodiment, the edge springs 242 incorporate lever arms 258 and hooks 260 which help secure the edge springs 242 to the deck wires 226 and which enhance the side-to-side stability of the assembly 210. While not fully enumerated here, it can be seen that additional features of the upper and lower support decks 212 and 214 as well as the edge springs 242 are similar to those described with respect to the previous embodiments. Therefore, it is not believed that those features need to be further discussed and reference should be made to the prior discussion with respect to those features.

Referring now to FIGS. 12–15, the spring module 216 will now be discussed in greater detail. As seen in FIG. 12, the spring module 216 is formed from a single piece of wire which is formed or bent into the desired configuration. The opposing ends of the formed wire are secured together by a ferrule or clip 268 providing the spring module 216 as a continuous loop. The spring module 216 includes a pair of vertically yieldable spring portions 262 which are connected to one another at their upper and lower ends by connecting bars 264 and 265. While not specifically required for proper operation of the present invention, the yieldable portions 262 of the spring modules 216 are generally formed as mirrored images one another. By providing the spring module 216 as a continuous loop of formed wire, the connecting bars 264 and 265 of the spring module cooperate with the deck wires 226 to form and operate as part of the upper and lower support decks. Thus, the stability and performance of the opposing sleep surfaces of the assembly will be the same.

The upper and lower connecting bars 264 and 265 merge with the yieldable portions 262 respectively at upper and lower attaching bars 266 and 267. The attaching bars 266 and 267 are bent approximately 90° from the connecting bars 264 and 265 and are generally parallel to the cross wires 230 when the spring module 216 is incorporated into the assembly 210 thereby allowing the use of clips (not shown) to retain the spring module 216 in position. In the illustrated embodiment, the yieldable portions 262 operate as variable rate spring elements during loading of the module 216.

Progressing from the upper attaching bar 266 to the lower attaching bar 267, it can be seen that the yieldable portions 262 generally take the shape of a helix or corkscrew and are formed from a series of segments 280 which are inclined and bent with respect to the proceeding or succeeding inclined segment 280. By varying the inclination of each segment 280, the length of each segment 280, as well as the angle between succeeding segments 280, the yieldable portions 262 can be caused to exhibit a variable spring rate. The variable spring rate of the spring module 216 is generally shown by FIGS. 13–15 where the spring module 216 is progressively loaded.

As seen in FIG. 13, the spring module 216 is in its uncompressed state. As a load is initially applied to the spring module 216 as in FIG. 14, the uppermost and lowermost inclined segments 280 are the first to exhibit significant deflection relative to the remaining segments 280. Further loading of the spring module 216 results in the remainder of the inclined segments 280 being further deflected toward one another as seen in FIG. 15.

Figure 11:
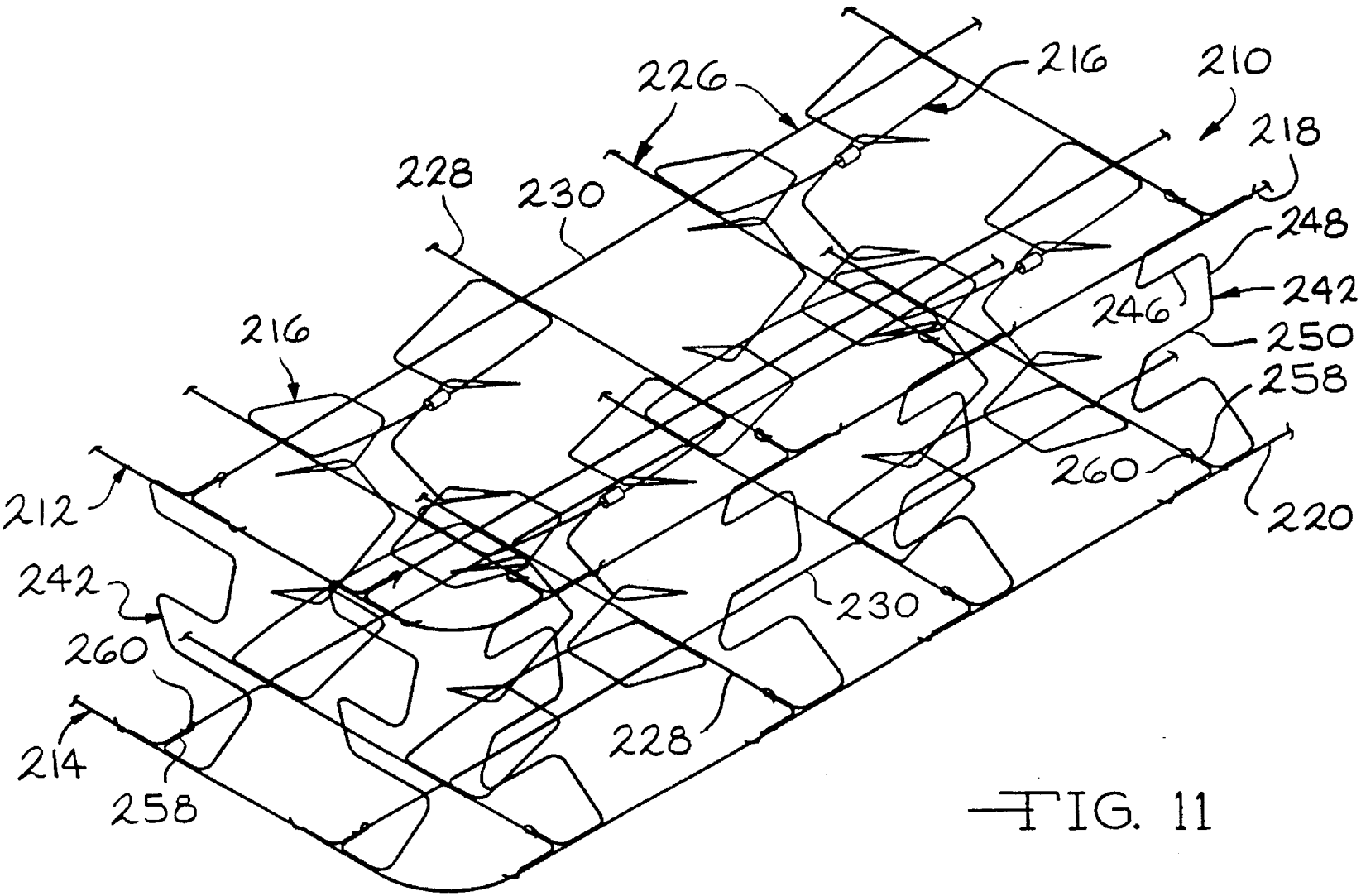
FIG. 11 is a diagrammatic perspective view of another formed wire mattress assembly constructed according to the principles of the present invention.
Figure 16:
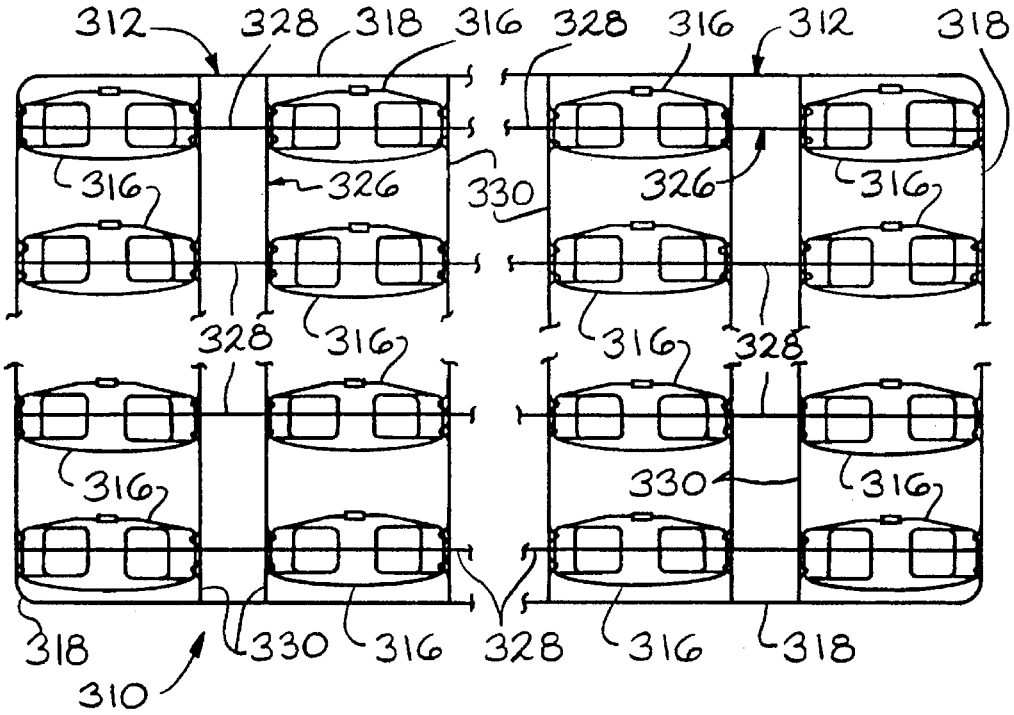
FIG. 16 is a top plan view of a formed wire mattress assembly according to another embodiment of the present invention.

Referring now to FIG. 16, a variation of the embodiment illustrated in FIG. 11 is illustrated therein and designated as formed wire mattress assembly 310. The assembly 310 is similar to the assembly 210 seen in FIG. 11 in that it incorporates a similar upper support deck 312 and lower support deck (not shown). The upper support deck 312 and lower support deck are again formed as grid networks made up of border wires 318 and deck wires 326, the deck wires 326 including long wires 328 and cross wires 330. Additionally, the upper support deck 312 and lower support deck are connected together and yieldably supported relative to one another by spring modules 316. Spring modules 316 are the same as those seen in FIG. 12.

The assembly 310, however, does not incorporate any edge springs as found in the prior embodiments. Rather, the spring modules 316 are positioned between the upper deck 312 and lower deck with at least some of the spring modules 316 being located adjacent to the upper deck 318 and lower border wires to provide edge support. In the prior embodiments, the spring modules were positioned in the assemblies at a location interiorly of the border wires and did not specifically provide any edge support.

Figure 17:
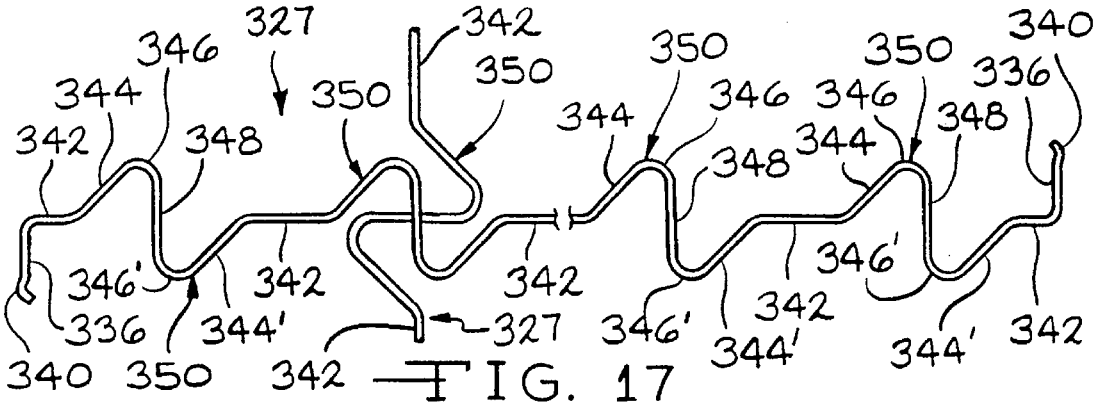
FIG. 17 is a plan view of a formed deck wire as might be incorporated into the formed wire mattress assembly of the present invention.

The final figure, FIG. 17, illustrates an alternate deck wire 327 which can be incorporated into any of the embodiments of the present invention. In describing the deck wire 327, however, reference will only be made to the embodiment illustrated in FIG. 11.

The deck wire 327 can be used as either a long wire 228, a cross wire 230, or both and includes a transverse portion which extends between opposing terminal ends thereof. The ends of the deck wire 327 form attaching bars 336 which are substantially perpendicular to the border wires 218 and 220 and to which they are attached by clips (not shown). Since the deck wire 327 can form either a long wire or a cross wire, the transverse portion can extend either lengthwise or crosswise of the assembly 210 and is only transverse in that it extends the distance between the attachment bars 336. At the free ends of the attachment bars 336 is a bend or ledge 340 which extends beyond the perimeter defined by the border wires 218 and 220. As with the prior embodiments, the ledge 340 prevents the border wires 218 and 220 from rolling around the attachment bars 336 and thereby increases the perimeter stability of the assembly 210.

At spaced intervals along the length of the transverse portion, the deck wire 327 is provided with a series of bent or formed sections, designated at 350 and located so as to coincide with the position of each spring module 216 and the intersection with another deck wire. For the sake of clarity, only one intersection of the deck wires 327 is illustrated and the spring module 216 is omitted from FIG. 17.

Each formed section 350 begins and ends with straight wire segments 342 that are generally coaxial with one another and transverse to the orientation of the attachment bars 336. Progressing from one straight wire segment 342 to the next, a divergent segment 344 diverges from the axis defined by the straight wire sections 342. The diverging segment 344 extends a predetermined distance away from the axis until a return bend segment 346 directs a bridging segment 348 generally perpendicular to the axis defined by the straight wire segments 342. The bridging segment 348 extends from the return bend segment 346 across the axis defined by the straight wire segments 342 until forming another return bend segment 346'. The return bend segments 346 and 346' are therefore generally located an equal distance away from the axis defined by the straight wire segments 342. From the return bend portion. 346', the deck wire 327 extends along a converging segment 344' until reaching the next straight wire segment 342. The formed portion 350 then repeats itself.

The formed portions 350 of the deck wires 327 provide the upper and lower support decks 212 and 214 with a system of surface springs that, as a result, are inherent in the construction of the support decks 312 and 314. The surface springs created by the formed portions 350 not only relieve the bridging stresses at the intersections of the deck wires 327, but they also provide for enhanced contouring of the surface loads encountered by the assembly 210.

It is to be understood that the invention is not limited to the exact construction illustrated and described above, but that various changes and modifications may be made without departing from the spirit and scope of the invention as defined in the following claims.

We claim:

1. A formed wire mattress assembly comprising:

an upper support deck formed of wire, said upper support deck having a generally rectangular shape and being defined along its perimeter by an upper border wire, said upper border wire further defining a pair of spaced apart sides and a pair of spaced apart ends, said support deck being connected to said border wire;

a lower support deck of formed wire, said lower support deck having a generally rectangular shape and being defined along its perimeter by a lower border wire, said lower border wire further defining a pair of spaced apart sides and a pair of spaced apart ends, said lower support deck being connected to said lower border wire, a plurality of springs arranged between and attached to said upper and lower decks, said springs yieldably supporting said upper and lower decks relative to one another.

2. A formed wire mattress assembly as set forth in claim 1 wherein said springs are of formed wire and have portions of wire at their upper and lower ends which form parts of said upper and lower decks.

3. A formed wire mattress assembly as set forth in claim 1 wherein said upper deck includes a plurality, of upper deck wires arranged in criss-cross fashion, said upper deck wires including long wires extending lengthwise of said assembly between said ends defined by said upper border wire, said upper deck wires also including cross wires extending crosswise of said assembly between said sides defined by said upper border wire; and a plurality of lower deck wires arranged in criss-cross fashion, said lower deck wires including long wires extending lengthwise of said assembly between said ends defined by said lower border wire, said lower deck wires also including cross wires extending crosswise of said assembly between said sides defined by said lower border wire, said upper support deck being vertically spaced and supported a predetermined distance above said lower support deck such that said upper border wire is located generally directly above said lower border wire and said upper deck wires are located generally directly above said lower deck wires.

4. A formed wire mattress assembly as set forth in claim 1 wherein said springs are all substantially identical to one another.

5. A formed wire mattress assembly as set forth in claim 1 wherein said springs are comprised of at least two different constructions.

6. A formed wire spring assembly as set forth in claim 5 wherein said lever arm coacts with one of said upper and lower deck wires to attach said edge spring to one of said upper and lower support decks, said lever arm having a returnly bent end forming a hook adapted to be looped over said one of said upper and lower deck wires.

7. A formed wire mattress assembly as set forth in claim 1 wherein said springs are variable rate springs.

8. A formed wire mattress assembly as set forth in claim 1 wherein said springs are non-coil springs.

9. A formed wire mattress assembly as set forth in claim 1 wherein at least some of said springs are attached to said upper and lower border wires.

10. A formed wire mattress assembly as set forth in claim 1 wherein said springs include a pair of spaced apart vertically yieldable portions integrally formed with each other.

11. A formed wire mattress assembly as set forth in claim 10 wherein said pair of yieldable portions each include upper and lower ends, said upper end of one of said yieldable portions being connected to said upper end of the other of said yieldable portions, said lower end of one of said yieldable portions being connected to said lower end of the other of said yieldable portions, said spring thereby forming a closed loop structure.

12. A formed wire mattress assembly as set forth in claim 11 wherein said upper ends of said yieldable portions are connected to each other by an upper connecting segment which forms part of said upper deck and wherein said lower ends of said yieldable portions are connected together by a lower connecting segment which forms part of said lower deck.

13. A formed wire mattress assembly as set forth in claim 11 wherein said edge springs are integrally formed with at least some of said upper and lower deck wires.

14. A formed wire mattress assembly as set forth in claim 11 wherein at least some of said edge springs are independent of said upper and lower deck wires.

15. A formed wire mattress assembly comprising:

an upper support deck of formed wire, said upper support deck having a generally rectangular shape and being defined along its perimeter by an upper border wire further defining a pair of spaced apart upper sides and a pair of spaced apart upper ends;

a lower support deck of formed wire, said lower support deck having a generally rectangular shape being defined along its perimeter by a lower border wire further defining a pair of spaced apart sides and a pair of spaced apart ends, said upper support deck being vertically spaced and supported a predetermined distance above said lower support deck such that said upper border wire is located generally directly above said lower border wire;

a plurality of intermediate springs arranged between and attached to said upper and lower support decks, said intermediate springs yieldably supporting said upper and lower decks relative to one another; and a plurality of edge springs arranged between and engaged to said upper and lower border wires, said edge springs yieldably supporting said upper and lower border wires relative to one another and thereby support to the perimeter of said assembly.

16. A formed wire mattress assembly as set forth in claim 15 wherein said upper support deck includes upper deck wires arranged in criss-cross fashion, said upper deck wires including long wires extending lengthwise of said assembly between said ends defined by said upper border wire and also including cross wires extending crosswise of said assembly between said sides defined by said upper border wire, said upper deck wires being connected to said upper border wire; and wherein said lower support deck includes lower deck wires arranged in criss-cross fashion, said lower deck wires including long wires extending lengthwise of said assembly between said ends defined by said lower border wire and also including cross wires extending crosswise of said assembly between said sides defined by said lower border wire, said lower deck wires being connected to said lower border wire, said upper deck wires being located generally directly above said lower deck wires.

17. A formed wire spring assembly as set forth in claim 16 wherein said edge springs include upper and lower ends, at least one of said ends of said edge spring terminating in a lever arm extending interiorly from said border wire and attaching said edge spring to one of said upper and lower support decks.

18. A formed wire spring assembly as set forth in claim 15 wherein said upper and lower decks include deck wires extending thereacross, at least some of said deck wires include surface spring means defined therein for providing increased resiliency to said deck wires and said upper and lower support decks.

19. A formed wire spring assembly as set forth in claim 18 wherein said deck wires each define an axis extending across said upper and lower support decks, said surface springs including formed portions diverging away from said axis.

20. A formed wire spring assembly as set forth in claim 19 wherein said upper and lower support decks generally define planes and said formed portions diverge away from said axis generally within said planes.

* * * * *